US005238586A

United States Patent [19]

Uphues et al.

[11] Patent Number: 5,238,586

[45] Date of Patent: * Aug. 24, 1993

[54] TEXTILE TREATMENT PREPARATIONS

[75] Inventors: Guenter Uphues, Monheim; Uwe Ploog, Haan; Klaudia Bischof, Werne, all of Fed. Rep. of Germany

[73] Assignee: Henkel Kommanditgesellschaft auf Aktien, Duesseldorf, Fed. Rep. of Germany

[ * ] Notice: The portion of the term of this patent subsequent to Oct. 31, 2006 has been disclaimed.

[21] Appl. No.: 741,402

[22] PCT Filed: Jan. 15, 1990

[86] PCT No.: PCT/EP90/00075

§ 371 Date: Jul. 23, 1991

§ 102(e) Date: Jul. 23, 1991

[87] PCT Pub. No.: WO90/08217

PCT Pub. Date: Jul. 26, 1990

[30] Foreign Application Priority Data

Jan. 23, 1989 [DE] Fed. Rep. of Germany ..... 3901820

[51] Int. Cl.[5] ..... D06M 10/08

[52] U.S. Cl. ..... 252/8.6; 252/8.7; 252/8.75; 252/8.8; 252/8.9; 252/174.17; 252/544

[58] Field of Search ..... 252/8.6, 8.7, 8.75, 252/8.8, 8.9, 544, 174.17

[56] References Cited

U.S. PATENT DOCUMENTS

| | | | |
|---|---|---|---|
| 3,454,494 | 7/1969 | Clark | 252/8.8 |
| 3,965,015 | 6/1976 | Bauman | 252/8.8 |
| 4,122,018 | 10/1978 | Waltenberger et al. | 252/8.6 |
| 4,162,984 | 7/1979 | DeBlock et al. | 252/8.8 |
| 4,786,439 | 11/1988 | Ploog et al. | 252/8.8 |
| 4,877,639 | 10/1989 | Ploog et al. | 252/8.8 |

FOREIGN PATENT DOCUMENTS

| | | |
|---|---|---|
| 0038862 | 11/1981 | European Pat. Off. . |
| 3530302 | 3/1987 | Fed. Rep. of Germany . |
| 3601856 | 7/1987 | Fed. Rep. of Germany . |
| 3730792 | 3/1989 | Fed. Rep. of Germany . |

*Primary Examiner*—Paul Lieberman
*Assistant Examiner*—William S. Parks
*Attorney, Agent, or Firm*—Ernest G. Szoke; Wayne C. Jaeschke; Real J. Grandmaison

[57] ABSTRACT

Textile treatment preparations based on the condensates of aliphatic monocarboxylic acids or amide-forming derivatives thereof with optionally hydroxyl-substituted polyamines and an addition of dispersion accelerators from the group of certain monosaccharides and hydrogenation products thereof, polyols and natural and synthetic hydrophilic polymers show particularly good dispersibility, even in cold water, if the amino groups unreacted during the condensation reaction are only partly neutralized with low molecular weight, optionally hydroxyl-substituted mono- or polycarboxylic acids.

16 Claims, No Drawings

TEXTILE TREATMENT PREPARATIONS

BACKGROUND OF THE INVENTION

Field of the Invention

This invention relates to textile treatment preparations based on condensation products of carboxylic acids or carboxyloic acid derivatives with polyamines which show particularly good dispersibility in water. The invention also relates to a process for the production of the textile treatment preparations and to their use. In the context of the invention, textile treatment preparations are understood to be products which may be used in compositions for the processing of fibers and yarns, in detergents and in aftertreatment preparations for washed fabrics.

Discussion of Related Art

A variety of compounds of mixtures of compounds have been proposed for the treatment of textile fibers, yarns or fabrics, imparting desired properties to the textiles treated with them or being constituents of textile care preparations. The processing properties and wearing properties of the textiles and also their care can be improved, depending on the type or active substances used. U.S. Pat. No. 2,340,881, for example, describes condensates prepared from a hydroxyalkyl polyamine and a fatty acid glyceride. These condensates improve the surface slip and softness of the textiles treated with them. According to the teaching of this patent, the condensates are used in the form of aqueous dispersions. U.S. Pat. No. 3,454,494 relates to fatty acid condensates containing an addition of polyoxyalkylene compounds having a dispersing effect. German patent 19 22 046 describes detergents containing fatty acid condensates which, from their production, contain fatty acid partial glycerides having a dispersing effect. In German patent 19 22 047, these fatty acid condensates are also described as fabric softeners for, in particular, liquid laundry aftertreatment preparations. These and similar textile treatment preparations can be dispersed in water by heating the water and applying generally high shear forces or by dispersing the condensate still molten from its production in water. On account of the work involved, therefore, the manufacturer generally undertakes dispersion and supplies the user with the dispersions, which involves the transport of considerable quantities of water. According to the teaching of German patent application DE 35 30 302, hydrophilic dispersion accelerators are added to active substances of the type in question to improve their dispersibility. The effect of the dispersion accelerators is particularly good if, in accordance with the teaching of German patent application P 37 30 792.4, they are present in the reaction mixture during the actual condensation reaction. However, there is still a need for textile treatment preparations based on fatty acid condensates having improved dispersibility, above all in cold water, so that the users themselves can readily carry out the dispersion of the textile treatment preparations.

DESCRIPTION OF THE INVENTION

Other than in the operating examples, or where otherwise indicated, all numbers expressing quantities of ingredients or reaction conditions used herein are to be understood as modified in all instances by the term "about".

This problem was solved by a textile treatment preparation obtainable by reaction of a) aliphatic $C_{8-22}$ monocarboxylic acids or amide-forming derivatives thereof with b) optionally hydroxyl-substituted polyamines and subsequent neutralization of unreacted amino groups, the textile treatment preparation containing an addition of dispersion accelerators selected from the group of monosaccharides of the aldose and ketose type and the polyhydroxyl compounds derived therefrom by hydrogenation, polyols, such as in particular pentaerythritol, dipentaerythritol, trimethylol propane, alkyl glycosides, sorbitan esters, onto which ethylene oxide is optionally added, and natural and synthetic hydrophilic polymers, characterized in that 20 to 80 mol-% and more especially 30 to 60 mol-% of the unreacted amino groups are neutralized. In contrast to complete neutralization with stoichiometric or excess quantities of acid, this partial neutralization with understoichiometric quantities of acid surprisingly provides for improved dispersibility in cold water and for a lighter color of the reaction product.

Amide-forming derivatives of aliphatic monocarboxylic acids are understood to be the esters derived from natural or synthetic fatty acids or fatty acid mixtures with lower alkanols, such as for example methanol or ethanol, fatty acid glycerides and fatty acid halides. The derivatives in question are, for example, the derivatives emanating from lauric acid, myristic acid, palmitic acid, stearic acid, coconut oil fatty acid, tallow fatty acid or rapeseed oil fatty acid. The reaction products obtainable therefrom by reaction with polyamines are referred to hereinafter as fatty acid condensates and, where diethylenetriamine is reacted with 2 mol fatty acid or fatty acid derivatives, also include imidazolines.

Suitable polyamines are preferably derived from optionally hydroxyl-substituted ethylenediamine or diethylenetriamine, for example from dihydroxyethylenediamine, hydroxyethyl diethylenetriamine, hydroxypropyl diethylenetriamine and, in particular, hydroxyethyl ethylenediamine. N,N-dimethyl-1,3-diaminopropane, triethylenetetramine or tetraethylenepentamine are also suitable.

Lower carboxylic acids, more especially low molecular weight organic mono- or polycarboxylic acids optionally substituted by hydroxyl groups, such as for example glycolic acid, citric acid, lactic acid or acetic acid, are suitable for the neutralization of unreacted amino groups. Monobasic inorganic acids, such as for example hydrochloric acid or sulfonic acids, such as for example methanesulfonic acid or p-toluenesulfonic acid, are also suitable. In some cases, it can be useful to combine the reaction products according to the present invention with other textile treatment agents, for example with fabric softeners. Particularly suitable fabric softeners are the widely used dimethyl di-($C_{8-22}$-alkyl-/alkenyl)-ammonium salts, such as dimethyl ditallow alkyl ammonium chloride or dimethyl distearyl ammonium chloride or methosulfate. In that case, it is generally of advantage for the reaction products to be present in admixture with the other textile treatment agents during the partial neutralization of unreacted amino groups.

The monosaccharides of the aldose and ketose type or their hydrogenation products, which may be used as dispersion accelerators, contain 4, 5 or, in particular, 6 carbon atoms in the molecule. Examples are fructose, sorbose and, in particular, glucose, sorbitol and mannitol, which are inexpensively available and extremely effective. Polyols, such as in particular pentaerythritol, dipentaerythritol and trimethylol propane, are particularly suitable.

Suitable alkyl glycosides are obtained by the Fischer process by reaction of a monosaccharide with a fatty alcohol in the presence of an acidic catalyst. Alkyl glycosides, of which the alkyl group contains up to 16 carbon atoms, have long been known as surfactants.

Esters with saturated or unsaturated $C_{10-20}$ fatty acids, particularly sorbitan oleate, are suitable as sorbitan esters. In addition, 2 to 20 mol ethylene oxide may be added onto the sorbitan esters.

Other suitable dispersion accelerators are natural or synthetic hydrophilic polymers. A preferred natural polymer of this class is gelatine. Mixtures of gelatine and monosaccharides or hydrogenation products thereof are particularly suitable. Other useful natural hydrophilic polymers are, for example, guar, dextrin, gum arabic, agar agar, casein. Of the synthetic hydrophilic polymers, homopolymers or copolymers based on polyvinyl alcohol, polyacrylic acid and polyvinyl pyrrolidone are mentioned above all. All the suitable polymers are readily soluble or dispersible or swellable in water.

The additions of dispersion accelerator required to obtain rapid dispersibility in a short time are in particular between 0.5 and 10% by weight, based on the quantity of dispersion accelerator and fatty acid condensate. Textile treatment preparations which contain monosaccharides and/or hydrogenation products thereof, more especially glucose, sorbitol, mannitol or mixtures thereof, preferably in quantities of from 2.5 to 10% by weight, as dispersion accelerators have particularly good properties in the same way as textile treatment preparations containing from 5 to 10% by weight gelatine. The same applies to preparations containing mixtures of monosaccharides and/or hydrogenation products thereof with gelatine as dispersion accelerators. Preparations containing 1 to 5% by weight pentaerythritol as dispersion accelerator also have particularly good properties.

In some cases, the presence of other dispersants, for example fatty alcohol alkoxylates or oxoalcohol alkoxylates containing 10 to 20 carbon atoms in the alcohol component and 2 to 50 mol alkylene oxide, more especially ethylene oxide and/or propylene oxide, preferably tallow alcohol+50 mol ethylene oxide or coconut oil alcohol+5 mol ethylene oxide+4 mol propylene oxide, fatty acid partial glycerides and/or water-miscible solvents, such as for example propylene glycol or glycerol, is useful. The quantity of additional dispersants in the textile treatment preparations according to the invention may make up from 0.5 to 70% by weight of the textile treatment preparation.

The present invention also relates to a process for the production of the textile treatment preparations mentioned above. The process according to the invention is characterized in that 20 to 80 mol-% and preferably 30 to 60 mol-% of the unreacted amino groups are neutralized. In the production of the fatty acid condensates known per se. the fatty acid or the fatty acid derivative and the polyamine are used for example in a molar ratio of 1:1 to 3:1 (carboxylic acid to polyamine). The reaction components are heated together with continuous mixing, optionally in the presence of the dispersion accelerator, until substantially all the fatty acid or fatty acid derivative has been reacted. Unreacted amino groups are then neutralized with low molecular weight organic carboxylic acids or hydroxycarboxylic acids or monobasic inorganic acids, for example by mixing a melt of the fatty acid condensate with the calculated quantity of acid with salt formation or by forming the amine salt by dissolving or dispersing the reaction product in the organic acid or a solution of the organic acid. According to the invention, the acid used for salt formation is added in the quantity necessary to obtain 20 to 80 mol-% and preferably 30 to 60 mol-% neutralization. Unless the dispersion accelerator has been added during the actual condensation reaction, it is added after neutralization. The presence of an inert gas atmosphere and/or the addition of a reducing agent during the condensation reaction leads to particularly light-colored products. Hypophosphorous acid has proved to be a particularly suitable reducing agent. The textile treatment preparations according to the invention are obtained, for example, as powders, flakes or pellets and may readily be processed in water and, in particular, even in cold water to form stable dispersions. Mixing with water and subsequent gentle stirring is sufficient for this purpose. The dispersions obtained are extremely stable and show no tendency to separate. The dispersions of the textile treatment preparations are used in various ways for the treatment of fibers, yarns or fabrics. Fibers or yarns are treated by standard textile methods, such as the exhaust method, the dip-extract method, padding or spraying.

Where the textile treatment preparations according to the invention are used in detergents, they improve detergency and/or soften the washed laundry. Finally, the textile treatment preparations according to the invention may also be constituents of aftertreatment preparations for washed laundry, so that the laundry is made soft and antistatic. The aftertreatment of the washed laundry may normally take place during the final rinse or even during drying in an automatic dryer. Either the laundry is sprayed with a dispersion of the preparation during drying or the preparation is applied to a substrate, for example in the form of a flexible sheet-form textile material. The products according to the invention may differ in their composition according to the nature of the textile treatment, i.e. the fatty acid condensates may have a more or less large fatty acid component or a fatty acid component with fatty acid residues of different length. Products according to the invention containing from 0.5 to 1 preferably saturated fatty acid residue essentially containing 16 to 22 carbon atoms to one functional group of the polyamine, i.e. an amino or hydroxyl group, have proved to be particularly suitable for the treatment of fibers and yarns and for the aftertreatment of washed laundry. The aftertreatment preparations according to the invention are also eminently suitable for the production of aqueous fabric softener concentrates which, instead of the usual activesubstance concentration of around 5% by weight, have an active substance concentration of from 10 to 50% by weight. Products containing condensates of relatively short fatty acid esters, i.e. essentially containing 12 to 16 carbon atoms and from 0.3 to 1 and preferably from 0.3 to 0.5 fatty acid residues per functional group of the hydroxyalkyl polyamine, are preferably selected for use in detergents.

EXAMPLES

EXAMPLE 1

A fatty acid condensate known per se suitable for the processing of textiles was prepared by heating 1215 g (4.5 mol) technical stearic acid and 312 g (3 mol) aminoethyl ethanolamine under nitrogen for 2.5 hours to 200° C. in a three-necked flask equipped with a stirrer, thermometer, gas inlet pipe and distillation column and removing water at the same time. The reaction was continued until the acid value, as determined by DGF method C-V 2, had fallen to 2.0. The content of amine nitrogen still present, as determined by titration with perchloric acid in acetic acid medium, was 1.65%. After cooling to 90° C., the melt was converted on a flake-forming roller into light yellow, nontacky flakes having a melting range of 64° to 67° C.

1 a)

250.0 g (0.293 equivalent amine nitrogen) of the condensate were melted and first 6.2 g (0.102 mol) acetic acid and then 10.7 g sorbitol were added to the resulting melt at 90° to 100° C. The clear melt was then converted on a flake-forming roller into light yellow, brittle flakes.

1 b)

250.0 g (0.293 equivalent amine nitrogen) of the condensate were melted and first 11.1 g (0.102 mol) glycolic acid, 70%, and then 10.9 g sorbitol were added to the resulting melt at 90° to 100° C. The clear melt was again converted into flakes.

1 c)

250.0 g (0.293 equivalent amine nitrogen) of the condensate were melted and first 11.3 g (0.1 mol) lactic acid, 80%, and then 10.9 g sorbitol were added at 90° to 100° C. The clear melt was again converted into flakes.

1 d)

250.0 g (0.293 equivalent amine nitrogen) of the condensate were melted and first 10.1 g (0.102 mol) hydrochloric acid, 37%, and then 10.8 g sorbitol were added at 90° to 100° C. The clear melt was again converted into flakes.

EXAMPLE 2

(Comparison Example)

A product according to Example 1 was prepared and further treated as follows:

Quantities of 250.0 g (0.293 equivalent amine nitrogen) of the condensate were melted and the acids shown below and quantities of 10.8 g sorbitol were added at 90° to 100° C., after which the melts were converted into a flake form:

2 a) 17.8 g (0.293 mol) acetic acid
2 b) 31.9 g (0.293 mol) glycolic acid, 70%
2 c) 32.5 g (0.293 mol) lactic acid, 80%
2 d) 29.0 g (0.293 mol) hydrochloric acid, 37%

EXAMPLE 3

(Comparison Example)

250.0 g (0.293 equivalent amine nitrogen) of a condensate according to Example 1 were melted and only 11.1 g (0.102 mol) glycolic acid, 70%, were added to the resulting melt at 90° to 100° C. The melt was then converted into flakes.

EXAMPLE 4

351 g (1.3 mol) technical stearic acid and 104 g (1 mol) aminoethyl ethanolamine are reacted as in Example 1. The reaction was terminated after an acid value of 2.5 had been reached. The content of amine nitrogen still present was 2.31%. 16.2 g (0.144 mol) lactic acid, 80%, and then 11.1 g sorbitol were added to 250 g (0.413 equivalent amine nitrogen) of the condensate at 90° to 100° C. The clear melt was converted into flake form.

EXAMPLE 5

459 g (1.7 mol) technical stearic acid and 104 g (1 mol) aminoethyl ethanolamine were reacted as described in Example 1. The reaction was terminated after an acid value of 4 had been reached. The content of amine nitrogen still present was 1.17%. 11.8 g (0.105 mol) lactic acid, 80%, and then 10.9 g sorbitol were added to 250 g (0.209 equivalent amine nitrogen) of the condensate at 90° to 100° C. The clear melt was converted into flakes.

EXAMPLE 6

8.1 g (0.072 mol) lactic acid, 80%, 7.6 g sorbitol and then 81.7 g distearyl dimethyl ammonium chloride were added at 90° to 100° C. to 175 g (0.205 equivalent amine nitrogen) of the condensate according to Example 1. After a clear melt had formed, it was converted into flakes.

EXAMPLE 7

255.6 g (0.3 mol) hydrogenated beef tallow, saponification value 197.5, were melted in a three-necked flask equipped with a stirrer, a thermometer, a reflux condenser and an inlet pipe for inert gas, followed by the addition at 85° C. of 31.2 g (0.3 mol) aminoethyl ethanolamine and 16.0 g sorbitol. The mixture was stirred under nitrogen at 105° C. until the amine nitrogen content was 1.0%. Approximately 50 mol-% of the flask contents were then neutralized by addition of 12.1 g (0.11 mol) lactic acid, 80%. The melt, which was clear at 85° C., was converted into flakes.

EXAMPLE 8

(Comparison Example)

The procedure was as in Example 7 except that approximately 100 mol-% of the flask contents were neutralized with 24.2 g (0.22 mol) lactic acid, 80%.

EXAMPLE 9

830.7 g (0.98 mol) hydrogenated beef tallow, saponification value 197.5, were melted in a three-necked flask equipped with a stirrer, a thermometer, a distillation column and an inlet pipe for inert gas, followed by the addition at 80° C. of 533.0 g of a commercially available distearyl dimethyl ammonium chloride containing approximately 14% isopropanol and 11% water, 72.8 g sorbitol and 101.4 g (0.98 mol) aminoethyl ethanolamine. The temperature was increased to 100° C. while nitrogen was introduced and the pressure reduced slowly to 20 mbar commensurate with the formation of distillate. The reaction was terminated after an amine nitrogen content of 0.83% had been reached and the clear melt was converted into flakes.

300 g of the product obtained were melted, neutralized to a level of 50 mol-% with 10.0 g (0.090 mol) lactic acid and then converted into flakes.

EXAMPLE 10

(Comparison Example)

300 g of the product of Example 9 (0.178 equivalent amine nitrogen) were completely neutralized by addition of 19.3 g (0.178 mol) glycolic acid, 70%, and converted into flakes.

EXAMPLE 11

1100 g (4 mol) technical stearic acid were melted in the apparatus according to Example 9, followed by the addition at 90° C. of 206 g (2 mol) diethylenetriamine. While nitrogen was introduced, the temperature was increased to 210° C. over a period of 2 hours, followed by stirring for 1 hour. 85 g distillate were formed. The pressure was then reduced to 25 mbar and the product stirred for another 1.5 hours at 210° C. After cooling to 90° C., the product was converted into flakes. Analysis by UV spectroscopy showed an imidazoline content of 98.5%.

250 g (0.38 mol) of the product obtained were melted and, after the addition of 6.9 g (0.115 mol) glacial acetic acid and 10.7 g sorbitol, the melt was stirred at 95° to 100° C. until it became clear. The clear melt was then converted into flakes.

EXAMPLE 12

Testing of dispersibility

In a 125 ml wide-necked flask, 95 g tapwater (16°Gh=German hardness, 12° C.) or fully deionized water (18° C.) were poured over 5 g of the products of Examples 1 to 11 and left standing for 15 minutes. Swelling behavior was then evaluated. The contents of the flask were then stirred for 2 minutes with a magnetic stirrer and the degree of dispersity visually assessed. Further evaluations were made after 1 and 24 hours. The degree of dispersity was evaluated and marked as follows:

| | Marking features |
|---|---|
| Swelling: | 1 = homogeneous, single phase |
| | 2 = homogeneously disperse upper phase |
| | 3 = swollen flake structure still clearly discernible |
| | 4 = weakly wetted flakes as sediment |
| | 5 = flakes float unchanged on the surface |
| After stirring: | 1 = homogeneous, finely divided, weak translucence |
| | 2 = homogeneous, finely divided, no translucence |
| | 3 = homogeneous with coarse particles |
| | 4 = dispersion with gel-like particles |
| | 5 = slightly changed flakes |

The results are shown in Table 1 below.

TABLE 1

| | Evaluation of the degree of dispersity | | | | | | | |
|---|---|---|---|---|---|---|---|---|
| | Swelling | | After stirring | | After 1 h | | After 24 h | |
| Product | TW | fd | TW | fd | TW | fd | TW | fd |
| Example 1a | 2 | 2 | 2 | 2 | 1/2 | 1 | 1 | 1 |
| Example 1b | 2 | 2 | 2/3 | 2 | 2 | 1 | 1 | 1 |
| Example 1c | 2 | 2 | 1/2 | 1/2 | 1 | 1 | 1 | 1 |
| Example 1d | 3 | 3 | 3 | 3 | 2/3 | 2 | 2 | 1 |
| Example 2a | 3 | 3/4 | 3 | 3 | 2 | 2 | 2 | 1/2 |
| Example 2b | 4 | 3/4 | 3/4 | 3/4 | 3 | 3 | 2/3 | 2 |
| Example 2c | 3 | 3 | 2/3 | 3 | 2 | 2/3 | 1 | 1 |
| Example 2d | 5 | 4/5 | 3/5 | 3/5 | 3/5 | 3/5 | 3 | 3 |

TABLE 1-continued

| | Evaluation of the degree of dispersity | | | | | | | |
|---|---|---|---|---|---|---|---|---|
| | Swelling | | After stirring | | After 1 h | | After 24 h | |
| Product | TW | fd | TW | fd | TW | fd | TW | fd |
| Example 3 | 4/5 | 5 | 3/5 | 3/5 | 3/4 | 3/4 | 3/4 | 3/4 |
| Example 4 | 2/3 | 2/3 | 2/3 | 2/3 | 2 | 2 | 1/2 | 1/2 |
| Example 5 | 3 | 2/3 | 2/3 | 2/3 | 2 | 1/2 | 1 | 1 |
| Example 6 | 2 | 2 | 2 | 2 | 1 | 1 | 1 | 1 |
| Example 7 | 2/3 | 3 | 3 | 2/3 | 2/3 | 2 | 2 | 1/2 |
| Example 8 | 3/4 | 4 | 4 | 3/4 | 4 | 3/4 | 3 | 2/3 |
| Example 9 | 2 | 1/2 | 3 | 2/3 | 2/3 | 2 | 2 | 1 |
| Example 10 | 3/4 | 3 | 3/4 | 3 | 3 | 3 | 2/3 | 2/3 |
| Example 11 | 2/3 | 2/3 | 2 | 2 | 1 | 1 | 1 | 1 |

TW = tapwater
fd = fully deionized water

EXAMPLE 13

Testing of softening

Hardened terry cloth (approx. 60 g/sample) was placed in a Wacker vessel on rollers and treated with a liquor containing products of Table 2 in the form of 5% dispersions. All the tests were carried out under the same standard conditions:

| | |
|---|---|
| Water hardness | approx. 16° Gh |
| Liquor ratio | 1:10 |
| Quantity used | 0.15% active substance, based on fabric |
| Temperature | 15° C. |
| Treatment time | 5 minutes |

After the treatment, the fabric samples were spin-dried in a domestic dryer and dried in air. Softening was then independently evaluated by six people who awarded marks for feel ranging from 1=hard, rough to 4=soft, pleasant. The figures in Table 2 are the averages of the feel marks awarded by the six individuals.

TABLE 2

| Product | Feel mark |
|---|---|
| Example 1a | 3.5 |
| Example 2a | 3.5 |
| Example 3* | 3.5 |
| Example 6 | 4.0 |
| Example 9 | 4.0 |
| Example 10* | 4.0 |

*Dispersion at 70° C.

Table 1 shows that the dispersibility of the products according to the invention is better than that of the products of Comparison Examples 2, 3, 8 and 10 which do not correspond to the invention.

Table 2 shows that the improvement in cold water dispersibility is not accompanied by a loss of softening effect.

We claim:

1. A textile treatment composition prepared by condensation reaction of (a) an aliphatic $C_{8-22}$ monocarboxylic acid or amide-forming derivative thereof with (b) a polyamine in a molar ratio of about 1:1 to about 3:1 and subsequent neutralization of from about 30 to about 60 mol % of the unreacted amino groups, said composition containing from about 0.5 to about 10% by weight, based on the weight of said composition, of a dispersion accelerator selected from the group consisting of aldose and ketose monosaccharides and polyhydroxyl compounds derived therefrom by hydrogenation, a polyol, an alkyl glycoside, a sorbitan ester and a natural or synthetic hydrophilic polymer, whereby said composition is readily dispersible in cold water.

2. A composition as in claim 1 wherein said polyamine comprises a hydroxyl-substituted polyamine.

3. A composition as in claim 1 wherein said polyol is selected from the group consisting of pentaerythritol, dipentaerythritol and trimethylol propane.

4. A composition as in claim 1 wherein said sorbitan ester is alkoxylated.

5. A composition as in claim 1 wherein a fabric softener selected from dimethyl di-($C_{8-22}$-alkyl or alkenyl)-ammonium salts is present during the partial neutralization of said unreacted amino groups.

6. A process for the preparation of a textile treatment composition comprising condensing (a) an aliphatic $C_{8-22}$ monocarboxylic acid or amide-forming derivative thereof with (b) a polyamine in a molar ratio of about 1:1 to about 3:1, neutralizing from about 30 to about 60 mol % of the unreacted amino groups, and adding to said composition from about 0.5 to about 10% by weight, based on the weight of said composition, of a dispersion accelerator selected from the group consisting of aldose and ketose monosaccharides and polyhydroxyl compounds derived therefrom by hydrogenation, a polyol, an alkyl glycoside, a sorbitan ester and a natural or synthetic hydrophilic polymer, whereby said composition is readily dispersible in cold water.

7. A process as in claim 6 wherein said polyamine comprises a hydroxyl-substituted polyamine.

8. A process as in claim 6 wherein said polyol is selected from the group consisting of pentaerythritol, dipentaerythritol and trimethylol propane.

9. A process as in claim 6 wherein said sorbitan ester is alkoxylated.

10. A process as in claim 6 wherein a fabric softener selected from dimethyl di-($C_{8-22}$-alkyl or alkenyl)-ammonium salts is present during the partial neutralization of said unreacted amino groups.

11. A process for the treatment of textile fibers, yarns or fabrics comprising contacting said textile fibers, yarns or fabrics with a composition prepared by condensation reaction of (a) an aliphatic $C_{8-22}$ monocarboxylic acid or amide-forming derivative thereof with (b) a polyamine in a molar ratio of about 1:1 to about 3:1 and subsequent neutralization of from about 30 to about 60 mol % of the unreacted amino groups, said composition containing from about 0.5 to about 10% by weight of a dispersion accelerator selected from the group consisting of aldose and ketose monosaccharides and polyhydroxyl compounds derived therefrom by hydrogenation, a polyol, an alkyl glycoside, a sorbitan ester and a natural or synthetic hydrophilic polymer, whereby said composition is readily dispersible in cold water.

12. A process as in claim 11 wherein said polyamine comprises a hydroxyl-substituted polyamine.

13. A process as in claim 11 wherein said polyol is selected from the group consisting of pentaerythritol, dipentaerythritol and trimethylol propane.

14. A process as in claim 11 wherein said sorbitan ester is alkoxylated.

15. A process as in claim 11 wherein a fabric softener selected from dimethyl di-($C_{8-22}$-alkyl or alkenyl)-ammonium salts is present during the partial neutralization of said unreacted amino groups.

16. A process as in claim 11 wherein said textile fibers, yarns or fabrics are contacted with said composition during or after washing said textile fibers, yarns or fabrics.

* * * * *